US008052408B2

(12) United States Patent
Kang et al.

(10) Patent No.: US 8,052,408 B2
(45) Date of Patent: Nov. 8, 2011

(54) TWO-WAY PRE-STRESS SYSTEM AND BENDING DEVICE THEREFOR

(75) Inventors: Dong-Ok Kang, Kwacheon (KR); Man-Geun Yoon, Sungnam (KR); Hyun-Yang Shin, Seoul (KR); Yeong-Seon Kim, Dubai (AE)

(73) Assignee: Samsung Corporation (KR)

( * ) Notice: Subject to any disclaimer, the term of this patent is extended or adjusted under 35 U.S.C. 154(b) by 675 days.

(21) Appl. No.: 12/132,877

(22) Filed: Jun. 4, 2008

(65) Prior Publication Data

US 2008/0302034 A1 Dec. 11, 2008

(30) Foreign Application Priority Data

Jun. 5, 2007 (KR) ..... 10-2007-0054961

(51) Int. Cl.
*B28B 21/60* (2006.01)

(52) U.S. Cl. ..... 425/111; 425/123; 425/125; 249/50; 264/228; 264/229

(58) Field of Classification Search ..... 425/111, 425/123, 125; 264/228, 229; 249/50
See application file for complete search history.

(56) References Cited

U.S. PATENT DOCUMENTS 2,820,606 A * 1/1958 Barredo De Valenzuela ..... 254/29 A
3,041,702 A * 7/1962 Schwab ..... 264/228
3,086,273 A * 4/1963 Welborn ..... 264/228
5,471,812 A * 12/1995 Muller ..... 52/745.19

* cited by examiner

*Primary Examiner* — Maria Veronica Ewald
(74) *Attorney, Agent, or Firm* — Cantor Colburn LLP

(57) ABSTRACT

Disclosed is a two-way pre-stress system for applying pre-stress to a member of a structure by a pre-tendon method, the system comprising: a mold for forming the member, the mold having a concrete pouring space; a supporter installed outside the mold; at least one horizontal tendon installed in the mold in a horizontal direction; a horizontal tendon settling device installed at the supporter, for settling the horizontal tendon in the mold; at least one vertical tendon installed in the mold in a vertical direction; a vertical tendon settling device installed at the supporter, for settling the vertical tendons in the mold; and a bending device installed at the supporter and combined with at least one of the vertical tendon, for forming a bent portion in at least one vertical tendon in a deep portion of the member.

6 Claims, 11 Drawing Sheets

TWO-WAY PRE-STRESS SYSTEM AND BENDING DEVICE THEREFOR

BACKGROUND OF THE INVENTION

1. Field of the Invention

The present disclosure relates to a construction field, and more particularly, to a system for pre-stressing a member of a structure by pre-tendon method.

2. Description of the Background Art

A pre-stress refers to a method for pre-stressing a member in an opposite direction with respect to a direction of a bending moment and a shear stress generated at a member by an external force, in which a tendon to which a tensile force has been applied is settled in the member.

A method for applying pre-stress to the member of the structure such as a beam, a girder, etc. is largely classified into a pre-tendon method and a post-tendon method.

According to the pre-tendon method, a tendon is installed at a mold, pre-stressed, and then concrete is poured into the mold. And once the poured concrete is cured, the tendon is settled into the member. After the poured concrete is cured, the tendon is cut.

The pre-tendon method is convenient since no further process such as grouting is required. However, the pre-tendon method has a disadvantage that a process for bending and installing the tendon in the member is difficult.

According to the post-tendon method, a sheath is arranged in a mold with a certain shape, and then concrete is poured into the mold. After the poured concrete is cured, a tendon is inserted into the sheath and pre-stressed. At the same time, both end portions of the tendon is settled into both end portions of a member.

The post-tendon method has an advantage that the tendon can be easily bent by the sheath. However, the post-tendon method has a disadvantage that further process such as an additional grouting between the sheath and the tendon is required. Accordingly, the post-tendon method is more complicated.

The conventional pre-stress method has been applied to a member only in a vertical direction (length direction) of the member due to the following reasons.

Influence of stress generated from the member in a horizontal direction (width direction) is less than influence of stress generated from the member in a vertical direction. Furthermore, it is difficult to arrange the tendon in the member in both directions, horizontal and vertical directions.

In case of a beam having a width less than a length, it is sufficient to perform a pre-stress only in a vertical direction.

However, in case of a member such as a slap and a box girder having a length and a width that are almost equal to each other, influence of stress generated in a horizontal direction of the member is too large to be ignored. Accordingly, pre-stress is applied not only in a horizontal direction but also in a vertical direction for structural stability.

Consequently, it is required to develop techniques for applying pre-stress in both directions, a horizontal direction and a vertical direction.

SUMMARY OF THE INVENTION

Therefore, an object of the present disclosure is to provide a two-way pre-stress system and a bending device capable of effectively resisting a stress generated from a member in horizontal and vertical directions.

To achieve these and other advantages and in accordance with the purpose of the present disclosure, as embodied and broadly described herein, there is provided a two-way pre-stress system for applying pre-stress to a member of a structure by a pre-tendon method, the system comprising: a mold for forming the member, the mold having a concrete pouring space; a supporter installed outside the mold; at least one horizontal tendon installed in the mold in a horizontal direction; a horizontal tendon settling device installed at the supporter, for settling the horizontal tendon in the mold; at least one vertical tendon installed in the mold in a vertical direction; a vertical tendon settling device installed at the supporter, for settling the vertical tendons in the mold; and a bending device installed at the supporter and combined with at least one of the vertical tendon, for forming a bent portion in at least one vertical tendon in a deep portion of the member.

The vertical tendon may comprise a linear vertical tendon linearly installed; and a bent vertical tendon having a bent portion formed by the bending device.

The horizontal tendon may be settled at an upper portion of the member, and the linear vertical tendon is settled at a lower portion of the member.

A central portion of the bent vertical tendon may be settled at a lower portion of the member, and both end portions of the bent vertical tendon may be upwardly inclined towards both end portions of the member in a vertical direction.

The bending device may be installed to penetrate a through hole formed at a bottom surface of the mold.

An operating space for assembling or disassembling the mold may be formed between the supporter and the mold.

To achieve these and other advantages and in accordance with the purpose of the present disclosure, as embodied and broadly described herein, there is also provided a bending device for the a two-way pre-stress system for applying a pre-stress to a member of a structure by a pre-tendon method, the system comprising a mold having a concrete pouring space, for forming the member; a supporter installed outside the mold; at least one horizontal tendon installed in the mold in a horizontal direction; a horizontal tendon settling device installed at the supporter, for settling the horizontal tendon in the mold; at least one vertical tendon installed in the mold in a vertical direction; and a vertical tendon settling device installed at the supporter, for settling the vertical tendons in the mold, wherein the bending device being installed at the supporter and combined with at least one of the vertical tendon, for forming a bent portion in at least one vertical tendon in a deep portion of the member; and wherein the bending device of the system comprises: a base portion installed at the supporter; a body portion installed at the base portion and positioned between the supporter and the mold; and a tendon supporting portion installed in the body portion, the tendon supporting portion penetrating a through hole formed at a bottom surface of the mold, and supporting the vertical tendon, for bending the vertical tendon.

The device of claim 7, wherein the tendon supporting portion is separatable from the body portion after the concrete has been poured and cured.

The tendon supporting portion may be coupled with the body portion by a hinge unit for vertical rotation so that the tendon supporting portion may be rotated in a vertical direction with respect to the body portion.

The tendon supporting portion may be coupled with the body portion by a hinge unit for horizontal rotation so that the tendon supporting portion may be rotated in a horizontal direction with respect to the body portion.

The body portion may be coupled with the base portion by a hinge unit for horizontal rotation so that the body portion may be rotated in a horizontal direction with respect to the base portion.

The device may further comprise a detachable supplementary supporting member installed between the body portion and the supporter so as to limit a rotation of the body portion in a horizontal direction.

At least one tendon through hole may be formed at the tendon supporting portion; and the corresponding vertical tendon may be inserted through the corresponding tendon through hole.

The tendon through hole may be downwardly curved at a portion of the tendon through hole contacting the vertical tendon.

The tendon supporting portion may comprise a plurality of supporting members coupled to the body portion; and a curved groove forming member coupled between the supporting members, for forming the tendon through hole.

A plurality of the curved groove forming members may be installed in a length direction of the supporting members.

A plurality of the supporting members may be arranged in a horizontal direction in parallel, and a plurality of the curved groove forming members may be respectively installed at a plurality of spaces formed between the supporting members.

To achieve these and other advantages and in accordance with the purpose of the present disclosure, as embodied and broadly described herein, there is also provided a two-way pre-stress system for a box girder, for applying a pre-stress to a member of a structure by a pre-tendon method, the system comprising: a mold having a concrete pouring space, for forming the member; a supporter installed outside the mold; at least one horizontal tendon installed in the mold in a horizontal direction; a horizontal tendon settling device installed at the supporter, for settling the horizontal tendon in the mold; at least one vertical tendon installed in the mold in a vertical direction; a vertical tendon settling device installed at the supporter, for settling the vertical tendons in the mold; and a bending device installed at the supporter and combined with at least one of the vertical tendon, for forming a bent portion in at least one vertical tendon in a deep portion of the member; wherein the member is the box girder constructed on a bridge.

The vertical tendon comprises: a linear vertical tendon linearly installed; and a bent vertical tendon having a bent portion formed by the bending device.

The horizontal tendon is installed on an upper plate of the box girder, the linear vertical tendon is installed on a lower plate of the box girder, and the bent vertical tendon is installed on a side plate of the box girder.

A central portion of the bent vertical tendon may be settled at a lower portion of the side plate of the box girder, and both end portions of the bent vertical tendon may be upwardly inclined towards both end portions of the side plate of the box girder in a vertical direction.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present disclosure, examples of which are illustrated in the accompanying drawings.

Hereinafter, a two-way pre-stress system according to the present invention will be explained in more detail with reference to the attached drawings.

Figure 1:
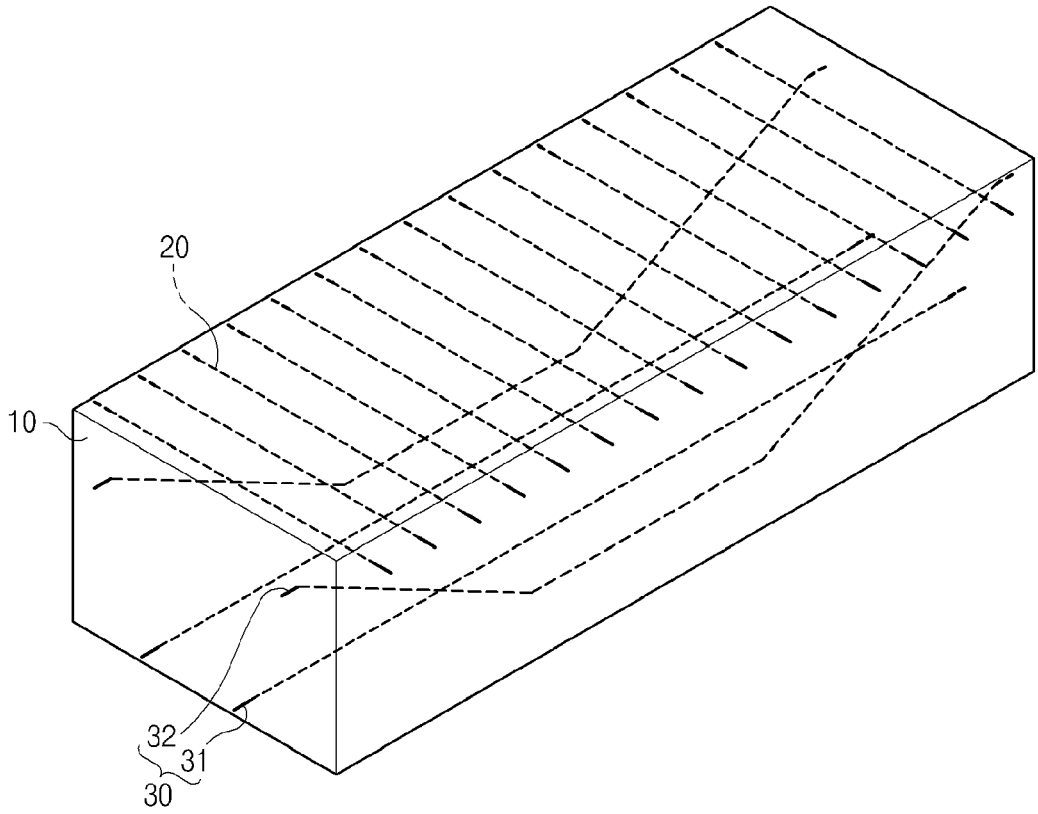
FIG. 1 is a perspective view showing a member constructed by a two-way pre-stress system according to the present invention.
Figure 2:
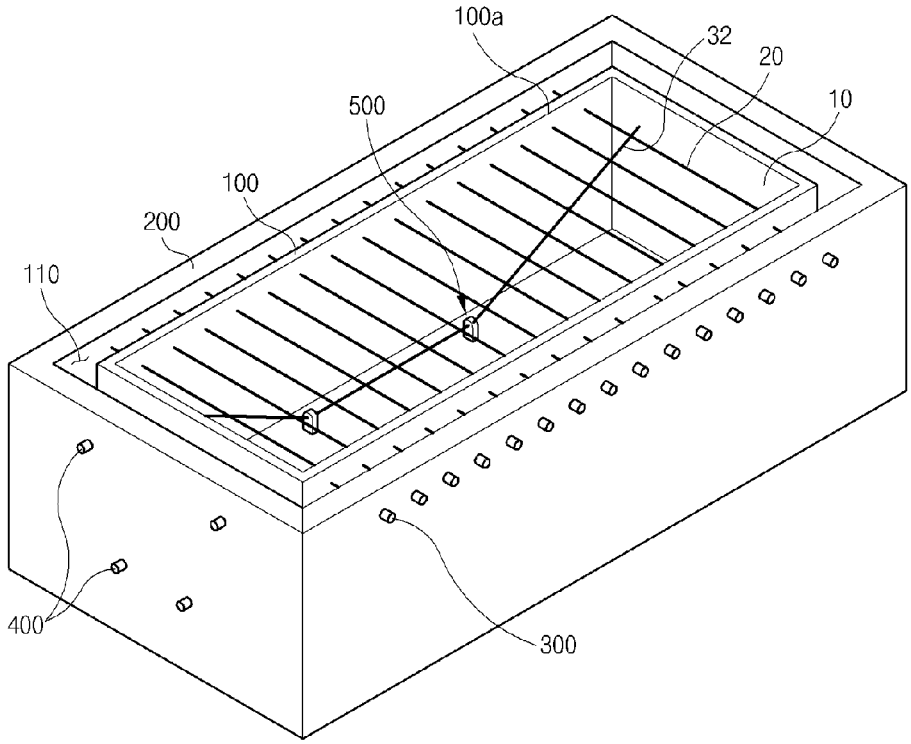
FIG. 2 is a perspective view showing the two-way pre-stress system according to the present invention.

As shown in FIGS. 1 and 2, the two-way pre-stress system according to the present invention serves to apply a pre-stress to a member 10 of a structure by a pre-tendon method.

The system comprises: a mold 100 having a concrete pouring space 100*a* for forming the member 10; a supporter 200 installed outside the mold 100; one or more horizontal tendons 20 installed in the mold 100 in a horizontal direction; a horizontal tendon settling device 300 installed at the supporter 200, for settling the horizontal tendons 20 in the mold 100; one or more vertical tendons 30 installed in the mold 100 in a vertical direction; a vertical tendon settling device 400 installed at the supporter, for settling the vertical tendons 30 in the mold 100; and a bending device 500 installed at the supporter 200 and combined with at least one of the vertical tendons 30, for forming a bent portion in at one or more vertical tendons 30 in a deep portion of the member 10.

Here, the member 10 of a structure refers to any member that requires a pre-stress for resisting a bending moment and a shear stress generated at the member by external force. The member 10 includes a beam, a slab, etc.

In the two-way pre-stress system according to the present invention, the horizontal tendons 20 and the vertical tendons 30 are arranged in the mold 100 in horizontal and vertical directions. In particular, a bent portion is formed at one or more vertical tendons 30.

The two-way pre-stress system according to the present invention has the following effects.

First, since a pre-stress is applied to the member 10 by installing the horizontal tendons 20 and the vertical tendons 30 together, a bending moment and a shear stress generated from the member 10 in horizontal and vertical directions can be effectively attenuated.

The two-way pre-stress system according to the present invention may have more advantageous effect when applied to the member 10 having a length and a width almost equal to the length such as a slab or a box girder.

Second, since the arrangement of the vertical tendons 30 can be adjusted by the bending device 500, the horizontal tendons 20 and the vertical tendons 30 are prevented from being interfered with each other.

Third, the bent portion of the vertical tendons 30 resists a bending moment generated by external force, the system may be advantageous in structural stability and the vertical tendons 30 are prevented from being interfered with the horizontal tendon 20.

Fourth, since a pre-stress is applied to the member by a pre-tendon method not by a post-tendon method, a settling device, a sheath, etc. are not additionally required. Accordingly, the whole process cost may be reduces.

All of the vertical tendons 30 may be settled to have a bent portion. Or according to a structure and a characteristic of the member 10, the vertical tendon 30 may be composed of a linear vertical tendon 31, and a bent vertical tendon 32 having a bent portion formed by the bending device 500.

When the horizontal tendon 20, the linear vertical tendon 31, and the bent vertical tendon 32 are together settled, as shown in FIG. 1, the horizontal tendon 20 is preferably settled at an upper portion of the member 10, the linear vertical tendon 31 is settled at a lower portion of the member 10. Accordingly, the horizontal tendons 20 and the vertical tendons 30 are prevented from being interfered with each other and the system be more excellent for structural stability.

Since the largest bending moment is generated at a central lower portion of the member 10 in a vertical direction, the linear vertical tendon 31 is preferably settled at the central lower portion of the member 10 for principally reinforcing the central lower portion.

In the same manner as the linear vertical tendon 31, a central portion of the bent vertical tendon 32 is settled at a lower portion of the member 10. Both end portions of the bent vertical tendon 32 are preferably upwardly inclined towards both end portions of the member 10 in a vertical direction. Preferably, the bent vertical tendon 32 has a 'U' shape for the structural stability.

Preferably, an operating space 110 is formed between the supporter 200 and the mold 100, thereby facilitating to assemble or disassemble the mold 100.

Figure 3:
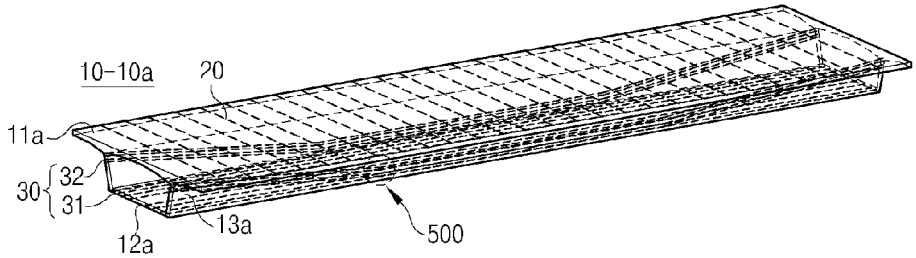
FIG. 3 is a perspective view showing a box girder constructed by the two-way pre-stress system according to the present invention.
Figure 4:
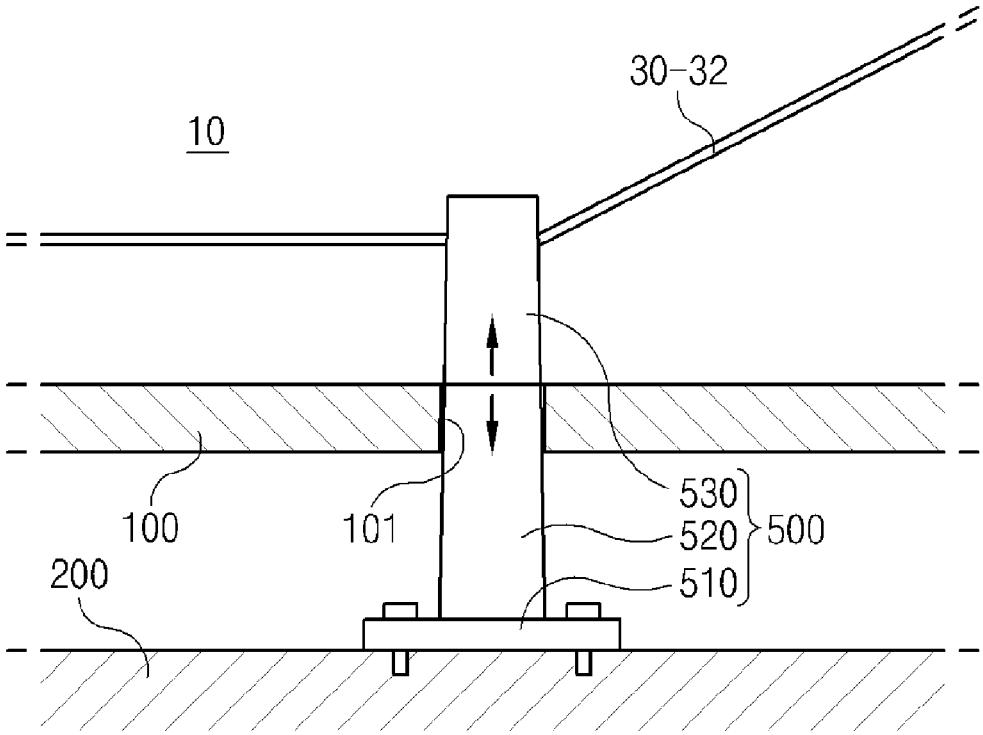
FIG. 4 is a sectional view showing a mounting structure for a bending device according to the present invention.
Figure 5:
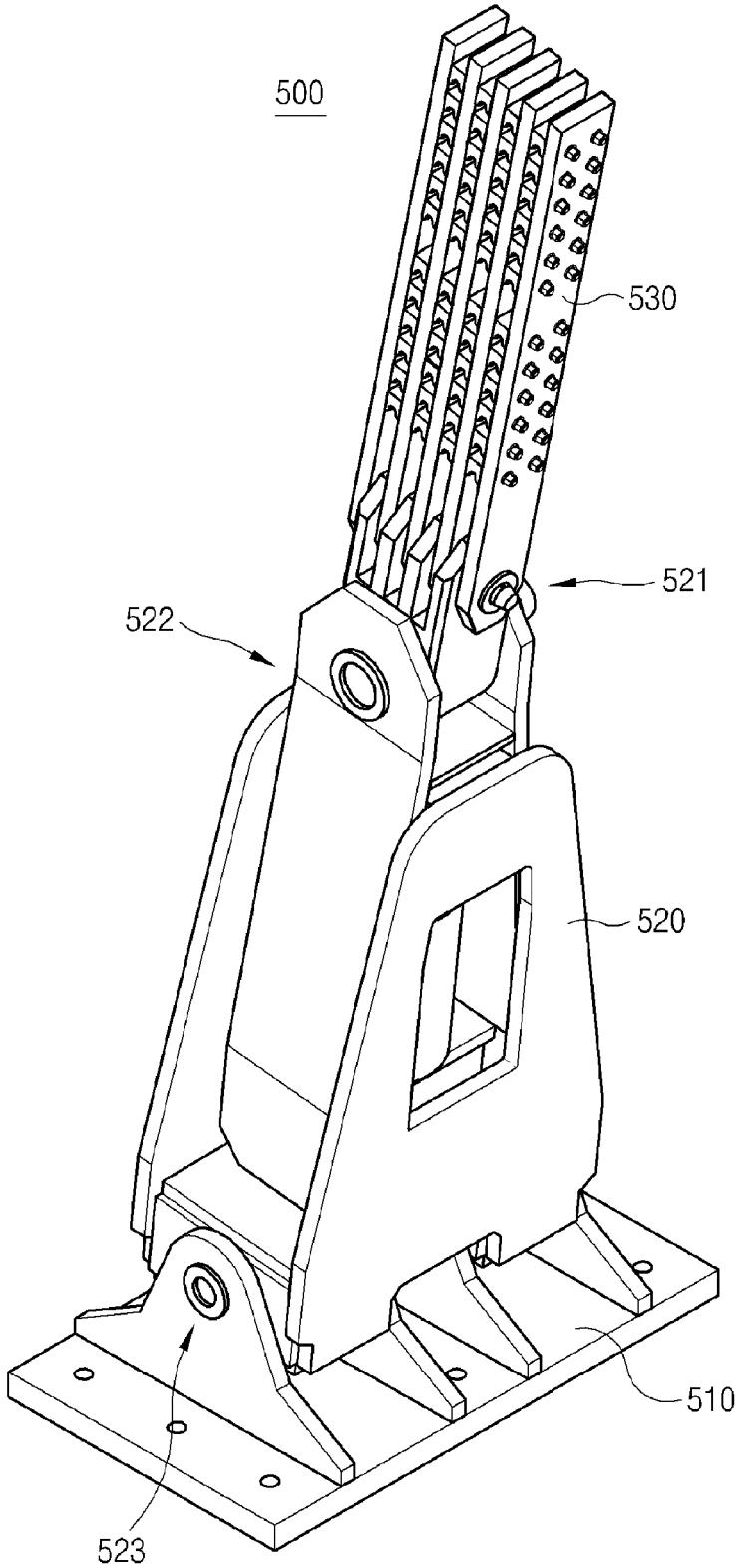
FIG. 5 is a perspective view showing the bending device according to the present invention.

FIG. 3 is a perspective view showing an example of the member 10, a box girder 10*a* constructed by the two-way pre-stress system according to the present invention.

As shown, the box girder 10*a* has a structure in which the horizontal tendons 20, the linear vertical tendons 31, and the bent vertical tendons 32 are together settled.

The horizontal tendons 20 are settled on an upper plate 11*a* of the box girder 10*a*, the linear vertical tendons 31 are settled on a lower plate 12*a* of the box girder 10*a*, and the bent vertical tendons 32 are settled on a side plate 13*a* of the box girder 10*a*.

A central portion of the bent vertical tendon 32 is settled at a lower portion of the side plate 13*a* of the box girder 10*a*. Both end portions of the bent vertical tendon 32 are upwardly inclined towards both end portions of the side plate 13*a* of the box girder 10*a* in a vertical direction.

Hereinafter, the bending device 500 of the two-way pre-stress system according to the present invention will be explained with reference to FIGS. 4 to 12.

The bending device 500 of the two-way pre-stress system comprises: a base portion 510 installed at the supporter 200 disposed outside the mold 100; a body portion 520 installed at the base portion 510 so as to be disposed between the supporter 200 and the mold 100; and a tendon supporting portion 530 which is installed in the body portion 520, penetrates the mold 100, and supports the vertical tendon 30, for being the vertical tendon 30.

The tendon supporting portion 530 of the bending device 500 penetrates the mold 100 via a through hole 101 formed at the mold 100. Here, a filling material such as a rubber packer may be used so that concrete poured into the mold 100 may be prevented from being leaked to air gap between the through hole 101 of the mold 100 and the bending device 500.

It is difficult to separate the tendon supporting portion 530 from the member 10 after concrete has been poured and cured in the mold 100. Accordingly, the tendon supporting portion 530 may have an integral structure with the member 10 by being buried in the member 10, in which the tendon supporting portion 530 can be easily separated from the body portion 520.

A buried position of the tendon supporting portion 530 in the mold 100 determines a forming point for the bent portion of the bent vertical tendon 32. The forming point for the bent portion may be changed according to a situation under construction.

Accordingly, the body portion 520 and the tendon supporting portion 530 are hingedly coupled with each other by a hinge unit 521 for vertical rotation, thereby rotating the tendon supporting portion 530 with respect to the body portion 520 in a vertical direction. Preferably, the tendon supporting portion 530 is formed to correspond to a changed forming point for the bent portion of the bent vertical tendon 32.

The body portion 520 and the tendon supporting portion 530 are hingedly coupled with each other by a hinge unit 522 for horizontal rotation, thereby rotating the tendon supporting portion 530 with respect to the body portion 520 in a horizontal direction. Preferably, the tendon supporting portion 530 is formed to correspond to a changed forming point for the bent portion of the bent vertical tendon 32.

Moreover when the body portion 520 and the base portion 510 are hingedly coupled with each other by a hinge unit 523 for rotation of the body portion 520, the body portion 520 can be rotated in a horizontal direction with respect to the base portion 510. Accordingly, a working for forming a bent portion at the bent vertical tendon 32 can be more facilitated.

When the body portion 520 is implemented to be rotated with respect to the base portion 510, a problem may occur in a working for fixing a position of the bending device 500 before concrete is poured into the mold 100. In order to solve the problem, a detachable supplementary supporting member 540 for fixing the body portion 520 rotated by the body rotating hinge portion 523 at a preset position may be further provided between the body portion 520 and the supporter 200, so as to limit a rotation of the body portion 520 in a horizontal direction.

Hereinafter, the tendon supporting portion 530 will be explained in more detail with reference to FIGS. 5 to 12.

As the tendon supporting portion 530, any structure for forming and supporting the vertical tendon 30 so as to be bent can be used. Referring to FIGS. 5 to 12, a tendon through hole 30*a* is formed at the tendon supporting portion 530, for being inserted by the vertical tendon 30.

Figure 6:
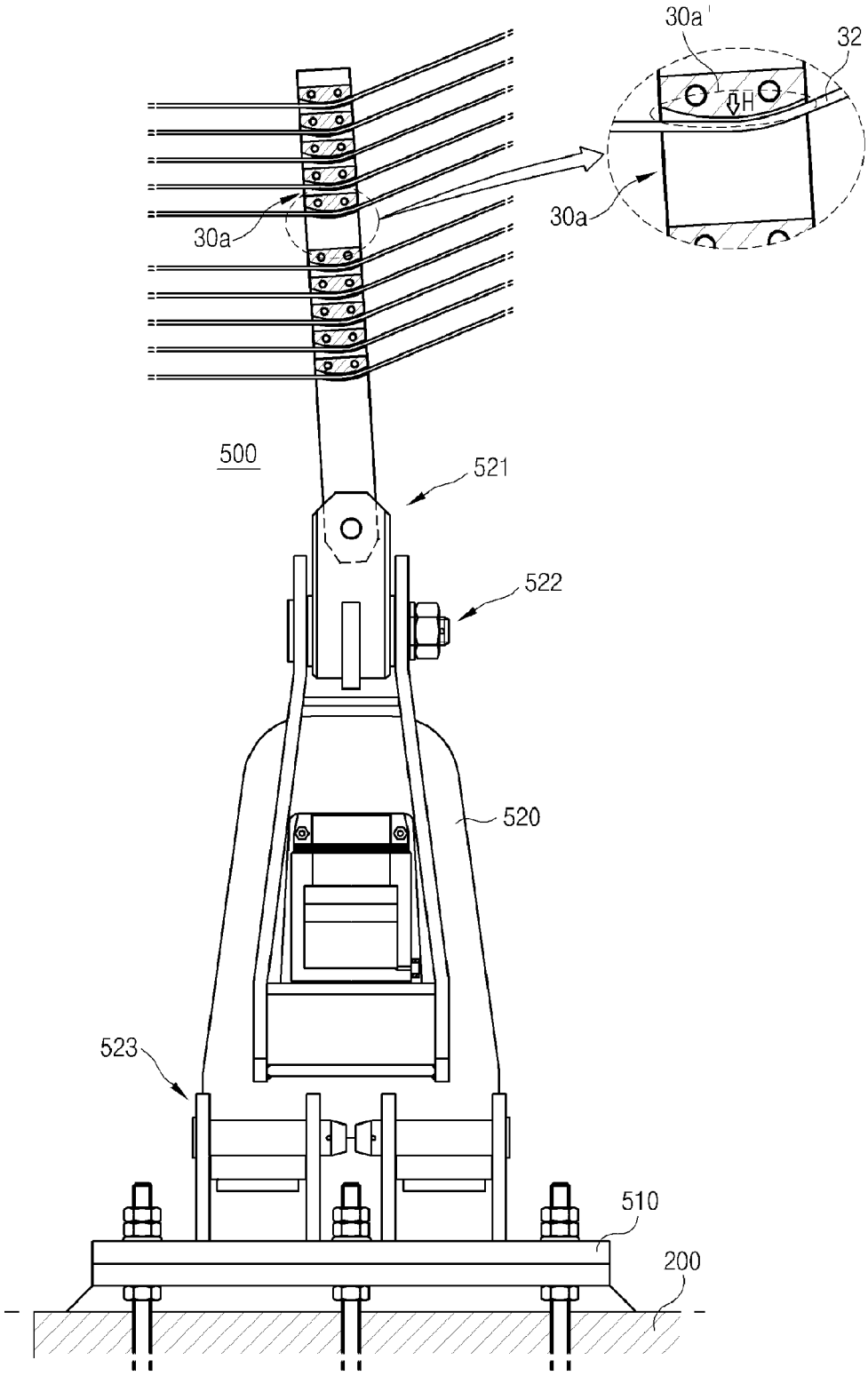
FIG. 6 is a frontal view showing the bending device according to the present invention.
Figure 7:
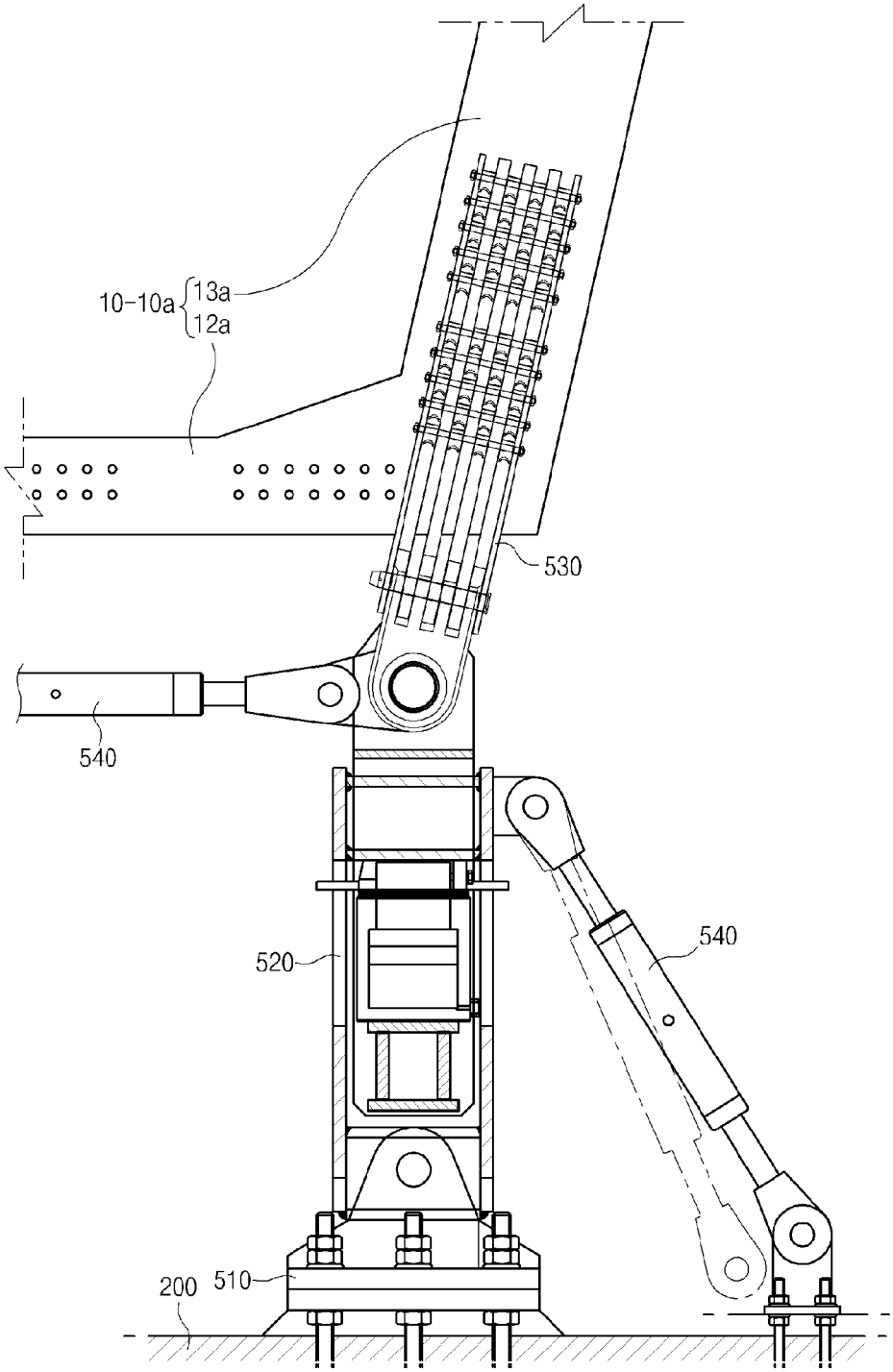
FIG. 7 is a lateral view showing the bending device according to the present invention.

In order to prevent the vertical tendon 30 from being damaged by a contact with the tendon through hole 30*a*, as shown in FIG. 6, a curved portion 30*a*' contacting the vertical tendon 30 is curved towards the vertical tendon 30 (the direction 'H' indicated by the arrow in FIG. 6). That is what the curved portion 30*a*' is a upper portion of the tendon through hole 30*a* and is downwardly curved.

The tendon supporting portion 530 may have an integral structure with the body portion 520, or an assembly structure to the body portion 520. Referring to FIGS. 8 to 12, the tendon supporting portion 530 has an assembly structure to the body portion 520. The tendon supporting portion 530 includes a plurality of supporting members 531 coupled to the body portion 520; and a curved groove forming member 532 coupled between the supporting members 531, for forming the tendon through hole 30*a*.

Figure 10:
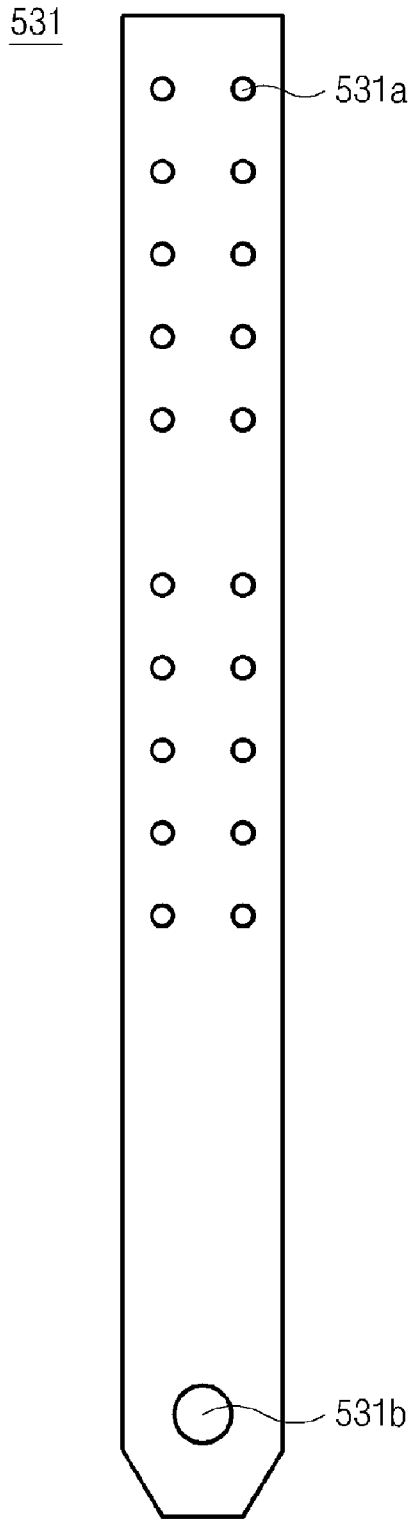
FIG. 10 is a frontal view showing supporting members according to the present invention.
Figure 11:
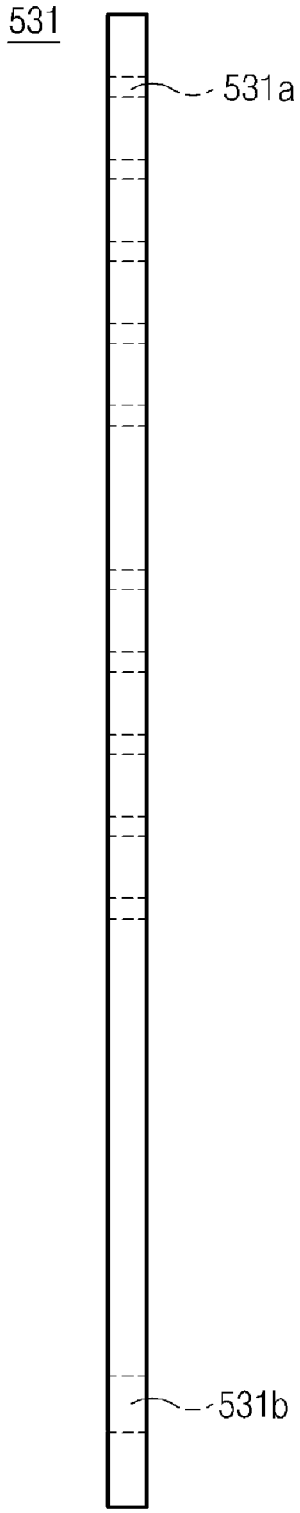
FIG. 11 is a lateral view showing the supporting members according to the present invention.
Figure 12:
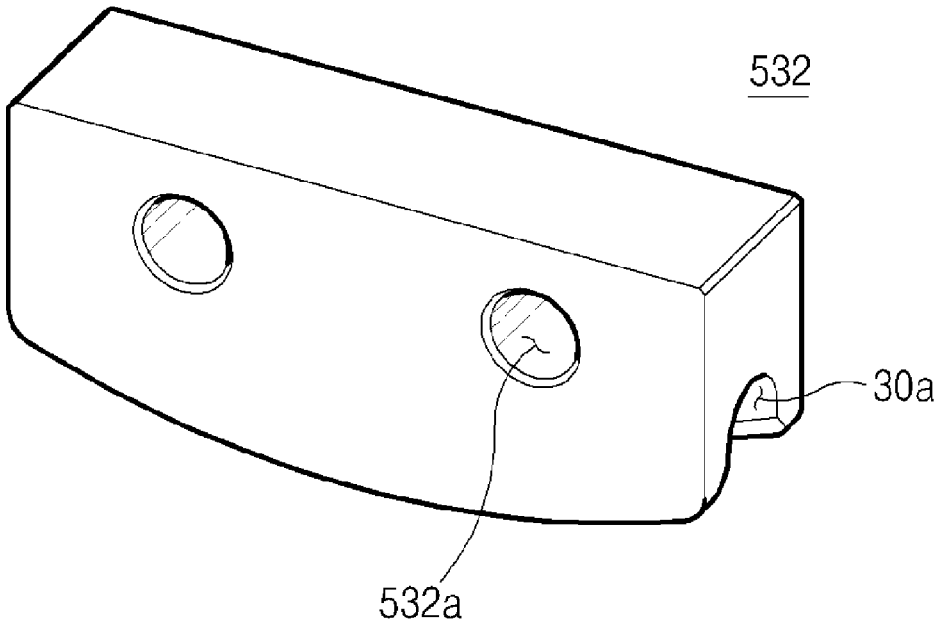
FIG. 12 is a perspective view showing curved groove forming members according to the present invention.

As shown in FIGS. 10 and 11, a plurality of the supporting members 531 are arranged in a horizontal direction in parallel. Then, as shown in FIG. 12, the curved groove forming members 532 are installed to the plurality of supporting members 531 by bolts, etc. The plurality of supporting members 531 and the curved groove forming members 532 may be respectively formed coupling holes 531*a* and 532*a* for coupling the bolts, etc.

In order to bend a plurality of the vertical tendons 30, it is necessary to form a plurality of the tendon through holes 30*a* corresponding to the number of the vertical tendons 30 to be bent at the tendon supporting portion 530.

Figure 8:
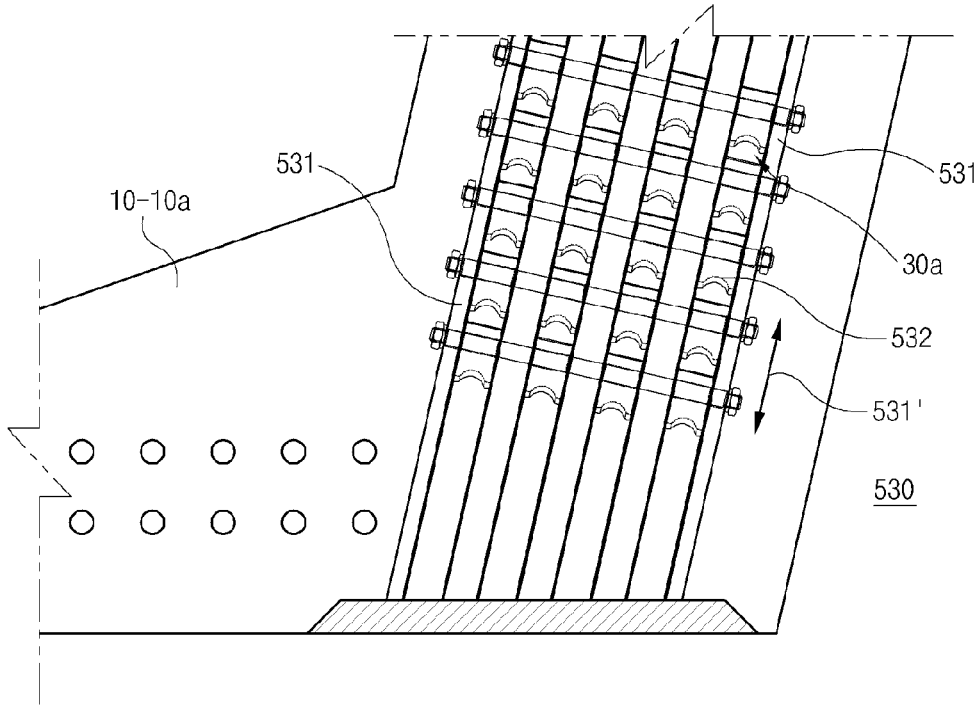
FIG. 8 is an enlargement view showing a main part of FIG. 7.
Figure 9:
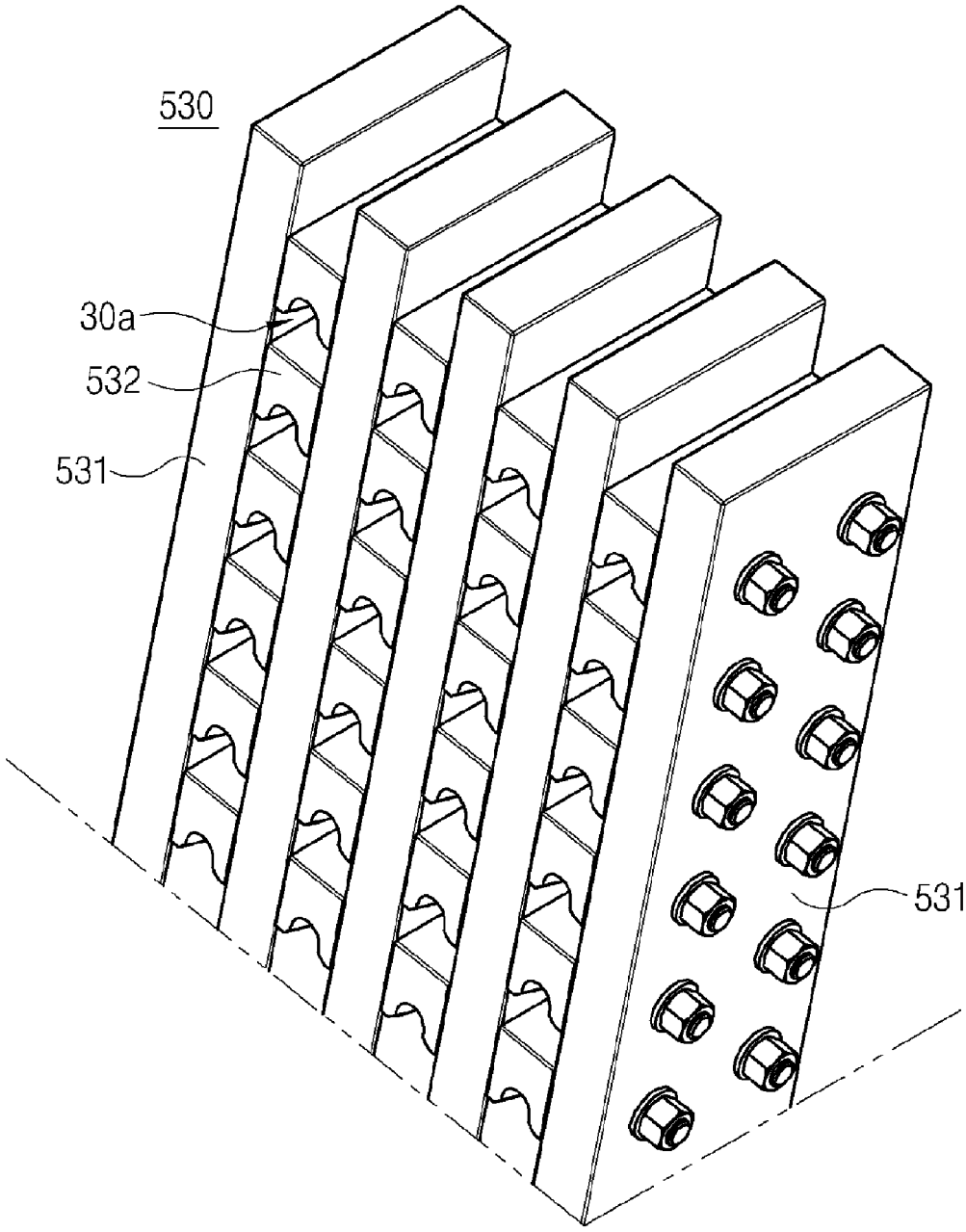
FIG. 9 is a perspective view showing a tendon supporting portion according to the present invention.

As shown in FIG. 8, a plurality of the curved groove forming members 532 may be mounted between the supporting members 531 in a length direction of the supporting member 531 (531' indicated by the arrow).

When a plurality of the supporting members 531 are arranged in a horizontal direction in parallel, the curved groove forming members 532 may be mounted at a plurality of spaces formed between the supporting members 531.

As aforementioned, the two-way pre-stress system according to the present invention can effectively resist a stress generated from the member not only in a vertical direction but also in a horizontal direction.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A two-way pre-stress system for applying pre-stress to a member of a structure by a pre-tendon method, the system comprising:

a mold for forming the member, the mold having a concrete pouring space;

a supporter installed outside the mold;

at least one horizontal tendon installed in the mold in a horizontal direction;

a horizontal tendon settling device installed at the supporter, for settling the horizontal tendon in the mold;

at least one vertical tendon installed in the mold in a vertical direction;

a vertical tendon settling device installed at the supporter, for settling the vertical tendon in the mold; and a bending device installed at the supporter and combined with at least one vertical tendon of the at least one vertical tendon, for forming a bent portion in at least one vertical tendon in a deep portion of the member;

wherein the bending device comprises:

a base portion installed at the supporter;

a body portion installed at the base portion and positioned between the supporter and the mold;

a tendon supporting portion installed in the body portion, the tendon supporting portion penetrating a through-hole in a bottom surface of the mold, and supporting the vertical tendon, for bending the vertical tendon; and a detachable supplementary supporting member installed between the body portion and the tendon supporting portion which limits a rotation of the body portion in a horizontal direction;

wherein the body portion is coupled with the base portion by a hinge unit for horizontal rotation so that the body portion may be rotated in a horizontal direction with respect to the base portion.

2. The system of claim 1, wherein the at least one vertical tendon comprises:

a linear vertical tendon linearly installed; and a bent vertical tendon having a bent portion formed by the bending device.

3. The system of claim 2, wherein the at least one horizontal tendon is settled at an upper portion of the mold, and the linear vertical tendon is settled at a lower portion of the mold.

4. The system of claim 3, wherein a central portion of the bent vertical tendon is settled at a lower portion of the mold, and both end portions of the bent vertical tendon are upwardly inclined towards both end portions of the mold in a vertical direction.

5. The system of claim 1, wherein the bending device is installed to penetrate a through-hole in a bottom surface of the mold.

6. The system of claim 1, further comprising an operating space for assembling or disassembling the mold between the supporter and the mold.

* * * * *